US012758840B2

(12) United States Patent
Andrukonis et al.

(10) Patent No.: US 12,758,840 B2
(45) Date of Patent: Oct. 13, 2026

(54) THROWING FOOTWORK TRAINER

(71) Applicants: Alan Bender, Chambersburg, PA (US); David Andrukonis, Alexandria, VA (US)

(72) Inventors: David Andrukonis, Alexandria, VA (US); Alan Bender, Chambersburg, PA (US)

(73) Assignee: Torch Sports, LLC, Chambersburg, PA (US)

( * ) Notice: Subject to any disclaimer, the term of this patent is extended or adjusted under 35 U.S.C. 154(b) by 175 days.

(21) Appl. No.: 18/826,586

(22) Filed: Sep. 6, 2024

(65) Prior Publication Data

US 2025/0083016 A1 Mar. 13, 2025

Related U.S. Application Data

(60) Provisional application No. 63/581,072, filed on Sep. 7, 2023.

(51) Int. Cl.
*A63B 69/00* (2006.01)
*A63B 71/06* (2006.01)
(Continued)

(52) U.S. Cl.
CPC ..... *A63B 69/0002* (2013.01); *A63B 69/002* (2013.01); *A63B 2069/0006* (2013.01);
(Continued)

(58) Field of Classification Search
CPC ..... A63B 69/0002; A63B 69/002; A63B 2069/0006; A63B 2071/0655;
(Continued)

(56) References Cited

U.S. PATENT DOCUMENTS 4,805,913 A * 2/1989 Bott ..... A63B 69/3667 473/270
5,150,902 A * 9/1992 Heisler ..... A63B 60/46 473/409
(Continued)

FOREIGN PATENT DOCUMENTS

CA 2604286 A1 * 10/2006 ..... A63B 69/0002
CA 3005847 A1 * 5/2017 ..... A63B 71/06
(Continued)

*Primary Examiner* — Kiley S Stoner
(74) *Attorney, Agent, or Firm* — Nath, Goldberg & Meyer; Joshua B. Goldberg

(57) ABSTRACT

This disclosure describes a training device for throwing a ball, relevant for all baseball and softball players, the quarterback position in football, lacrosse players, and all other athletes who use a similar throwing motion. Various embodiments described in this disclosure assist in teaching basic throwing footwork preferably while allowing the thrower's eyes to remain focused on the target. Basic throwing footwork involves beginning by standing with one's toes facing perpendicular to the target direction, stepping one's front foot forward and straight with toes rotating fully or partially toward the target, and finally allowing one's back leg to follow through and land alongside the front leg. These steps enhance power and accuracy. Various embodiments described in this disclosure help guide the thrower through these steps. Preferred embodiments are deployed as a long, narrow, and elevated device comprising a starting surface, a landing surface, and a gap between the two.

18 Claims, 9 Drawing Sheets

(51) Int. Cl.
*A63B 102/14* (2015.01)
*A63B 102/18* (2015.01)

(52) U.S. Cl.
CPC ..... *A63B 2071/0655* (2013.01); *A63B 2071/0694* (2013.01); *A63B 2102/14* (2015.10); *A63B 2102/18* (2015.10); *A63B 2102/182* (2015.10); *A63B 2210/50* (2013.01); *A63B 2214/00* (2020.08); *A63B 2243/007* (2013.01)

(58) Field of Classification Search
CPC ..... A63B 2071/0694; A63B 2102/14; A63B 2102/18; A63B 2102/182; A63B 2210/50; A63B 2214/00; A63B 2243/007; A63B 2209/00; A63B 2209/10; A63B 2225/09
USPC ..... 473/278–279, 416, 422
See application file for complete search history.

(56) References Cited

U.S. PATENT DOCUMENTS 5,642,880 A * 7/1997 Wiseman ..... A63B 69/0075 473/417
6,102,818 A * 8/2000 Hamilton ..... A63B 69/0002 473/452
6,386,996 B1 * 5/2002 Foster ..... A63B 69/0002 473/422
6,500,078 B1 12/2002 Williams et al.
6,945,883 B1 9/2005 Williams et al.
7,137,902 B1 * 11/2006 Wright ..... A63B 69/0059 473/277
7,955,224 B2 * 6/2011 Curley ..... A63B 21/4037 482/148
9,227,124 B1 * 1/2016 Sparks ..... A63B 69/0002
10,315,065 B1 * 6/2019 Soba ..... A63B 21/151
11,452,916 B1 * 9/2022 Kahn ..... A63B 24/0062
2005/0090323 A1 * 4/2005 Kellogg ..... A63B 69/3661 473/270
2005/0143200 A1 * 6/2005 Hedgepath ..... A63B 69/0002 473/452
2006/0030435 A1 * 2/2006 Opdyke ..... A63B 69/0002 473/453
2006/0068947 A1 3/2006 Kempf
2006/0142099 A1 * 6/2006 Trucks ..... A63B 69/0002 473/452
2007/0123389 A1 * 5/2007 Martin ..... A63B 69/32 482/8
2007/0202970 A1 * 8/2007 Miller ..... A63B 69/0002 473/451
2008/0188331 A1 * 8/2008 Shimizu ..... A63B 26/003 473/451
2009/0233737 A1 * 9/2009 Lerch ..... A63B 69/0002 473/452
2011/0021296 A1 1/2011 Johnston
2012/0232360 A1 * 9/2012 Maueler ..... A61B 5/6892 600/301
2012/0283080 A1 * 11/2012 Mayr ..... A63B 24/0006 482/142
2017/0128816 A1 * 5/2017 DeMarch ..... G09B 19/003
2017/0172331 A1 * 6/2017 Publicover ..... B32B 7/022
2019/0105546 A1 * 4/2019 Ferrara ..... A63B 21/4037
2019/0118066 A1 * 4/2019 Cardona ..... A63B 24/0062
2021/0106896 A1 * 4/2021 Fountaine ..... A63B 24/0062
2021/0187375 A1 * 6/2021 Postel ..... A63B 71/0622
2021/0291028 A1 * 9/2021 Carullo ..... A63B 69/0002
2021/0322819 A1 * 10/2021 Johnson ..... A61B 5/6895
2021/0331055 A1 * 10/2021 Lee ..... A63B 69/3667
2022/0379162 A1 * 12/2022 Way ..... A63B 21/4037
2023/0158387 A1 * 5/2023 Ward ..... A63B 69/0022 434/255
2023/0241450 A1 * 8/2023 Sanghera ..... A63B 24/0062 482/4
2024/0359076 A1 * 10/2024 Harris, Jr. ..... A63B 69/0071
2025/0032848 A1 * 1/2025 Delfin ..... A63B 21/4037

FOREIGN PATENT DOCUMENTS

CA 3070144 A1 * 7/2021 ..... A63B 21/4037
CN 110290842 A * 9/2019 ..... A61H 5/00
CN 110585647 A * 12/2019 ..... A63B 71/06
CN 112717346 A * 4/2021 ..... A63B 71/0669
CN 113713351 A * 11/2021 ..... A63B 71/0619
CN 114569955 A * 6/2022 ..... A63B 24/0075
CN 118022251 A * 5/2024 ..... A63B 71/0619
EP 0250643 A1 * 1/1988 ..... A63B 69/3667
GB 2571123 A * 8/2019 ..... A63B 71/0686
KR 20200092612 A * 8/2020 ..... A63B 71/0622
KR 20200110485 A * 9/2020 ..... H05B 47/165
KR 102257316 B1 * 5/2021 ..... A63B 69/3661
KR 102257321 B1 * 5/2021 ..... B32B 5/245
KR 20220065990 A * 5/2022 ..... A61B 5/6895
KR 20220087824 A * 6/2022 ..... A63B 21/4037
KR 20230138589 A * 10/2023 ..... A63B 21/4037
WO WO-2010012080 A1 * 2/2010 ..... A63B 69/36
WO WO-2022163954 A1 * 8/2022 ..... A63B 21/4037

* cited by examiner

THROWING FOOTWORK TRAINER

CROSS REFERENCE TO RELATED APPLICATIONS

This application claims the benefit under 35 U.S.C. § 119(e) of U.S. Provisional Patent Application Ser. No. 63/581,072 filed Sep. 7, 2023, which is incorporated herein by reference.

FIELD

This disclosure describes a training device for throwing a ball, relevant for all baseball and softball players, the quarterback position in football, lacrosse players, and all other athletes who use a similar throwing motion.

BACKGROUND

Throwing a ball is a core skill for many athletes, including all baseball, softball and lacrosse players; the quarterback position in football; and more. There is a basic ball throwing motion that athletes are taught early on and hone throughout their careers. This basic throw is also the foundation for any more nuanced and specialized throwing techniques that an athlete may learn later such as a baseball pitcher's windup and delivery, an outfielder's long toss, or a football quarterback's drop back and pass.

As used in this disclosure, the term basic throw means the simple step and throw that people do when they play catch in their yard, that athletes do when they warm up before games, and that t-ball coaches attempt to teach beginners. Elements of a good basic throw include proper grip, arm mechanics, footwork, and keeping one's eye on the target. A basic throw is a difficult skill to teach and learn because it involves multiple components that should occur in concert as part of one fluid motion, several of which are counterintuitive and unnatural to many beginners.

Footwork is an especially challenging aspect of throwing. For power and accuracy, basic throwing footwork comprises beginning by standing with one's toes facing perpendicular to the target direction, stepping one's front foot forward and straight with toes rotating fully or partially toward the target, and finally allowing one's back leg to follow through and land alongside the front leg. Beginning throwers struggle to understand and execute these steps. After a beginner understands and properly executes their first basic throw, it often takes several more years of repetition until the proper form becomes second nature, and many slip into bad habits along the way.

The embodiments described in this disclosure assist in teaching and reinforcing the basic throwing footwork. Using embodiments described in this disclosure may make the basic throwing footwork more intuitive for beginners and reinforce good habits for intermediate and advanced throwers. In some embodiments, the devices and methods described may teach and reinforce this proper throwing footwork while also allowing the thrower's eyes to remain on the target throughout the throwing motion. This not only helps athletes and throwers master basic throwing footwork, but also by doing so it frees the thrower and coach to focus on the remaining aspects of the basic throw, e.g., grip and arm mechanics.

BRIEF SUMMARY

Various embodiments described in this disclosure assist in teaching basic throwing footwork preferably while allowing the thrower's eyes to remain focused on the target.

As described above, basic throwing footwork involves beginning by standing with one's toes facing perpendicular to the target direction, stepping one's front foot forward and straight with toes rotating fully or partially toward the target, and finally allowing one's back leg to follow through and land alongside the front leg. These steps enhance power and accuracy.

Various embodiments described in this disclosure help guide the thrower through these steps. Preferred embodiments are deployed as a long, narrow, and elevated device comprising a starting surface, a landing surface, and a gap between the two. The starting surface preferably indicates ambidextrous foot placements for a thrower of either handedness, which guide the thrower to stand perpendicular to the direction of throw. The separation of the footprints is appropriate for the smallest throwers, while indications behind the back footprint guide throwers with wider stances when taking wider stances. Alternatively, either or both of the starting footprints may be deployed as movable overlays releasably attachable to a mat. When a thrower has found the starting (stationary) perpendicular stance, in preferred methods there is no further use for the visual indications.

In preferred embodiments, as the thrower begins to throw, the gap between the starting surface and the landing surface requires the thrower to step forward sufficiently to generate power, and the length of the forward landing surface allows throwers with longer strides to step farther. The forward landing surface preferably is sufficiently narrow so that the thrower's front foot must step straight, with toes rotating fully or partially toward the target, in order to clearly land on it. Finally, the height of the landing surface, together with the padding beneath it, is high enough that a thrower notices not landing on it, but preferably low enough that the thrower's back foot may follow through and stably land on the ground alongside the mat. While the thrower's eyes remain on the target, the thrower preferably can feel tactile feedback if the foot lands on the landing surface or alternatively if the foot misses and falls lower and on a different surface, for example by stepping in the gap or off the device.

Because of the flexible materials used in the preferred embodiments, the training device can be used on a variety of surfaces, from grass to dirt to pavement, including uneven surfaces, without wobbling or slipping. A preferred embodiment is sufficiently portable that a coach could carry several in each hand and fit a dozen in a car trunk.

DESCRIPTION OF VARIOUS EMBODIMENTS

The terminology used herein is for the purpose of describing particular embodiments only and is not intended to be limiting. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this disclosure belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing various embodiments, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the disclosure and the claims.

The present disclosure is to be considered as an exemplification of various embodiments and is not intended to limit the scope of the disclosure to the specific embodiments illustrated by the figures or description herein. FIGS. 1A-1F illustrate one embodiment, FIGS. 2A-2F a second embodiment, and FIGS. 3A-3F a third embodiment.

Figure 1A:
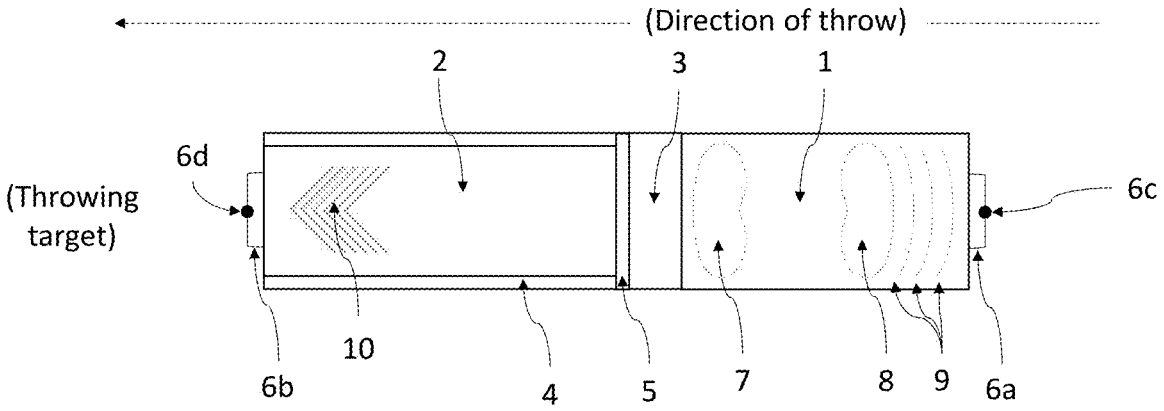
FIG. 1A is a plan view of a first embodiment.

As shown in FIG. 1A, a first embodiment comprises a starting surface 1, where a thrower begins a throw in the direction of arrows 10 by placing the front foot on front shoeprint 7 and the back foot on back shoeprint 8, or optionally if preferred, farther back as indicated by markings 9. Note that in this embodiment, the shoeprints are symmetrical (the toe/heel sides are mirror images of one another), making the training device ambidextrous (right-handed throwers can begin with their toes facing one direction and left-handed throwers can begin with their toes facing the opposite direction). Other embodiments, however, may deploy non-symmetrical shoeprints (for example, having toe outlines), and the handedness of throwers may be accommodated by releasable attachment of the shoeprints to provide rotation relative to the direction of throw.

In an exemplary method of using the depicted embodiment to complete a throw, the thrower then steps forward—enough to clear the gap between the starting surface 1 and landing surface 2—landing the front foot on landing surface 2. Note that to land on landing surface 2 requires a straight step, typically accompanied by a full or partial toe rotation toward the target.

In the first embodiment, a break between starting padding 3 and landing padding 4, and the flexibility of the backing 5 allows the embodiment to fold.

Carrying handles **6*a* and 6*b* in the depicted embodiment enhance carrying, and buttons 6*c* and 6*d*** allow the handles of the depicted embodiment to releasably connect together while the device is folded for tidy storage and transportation.

Figure 2A:
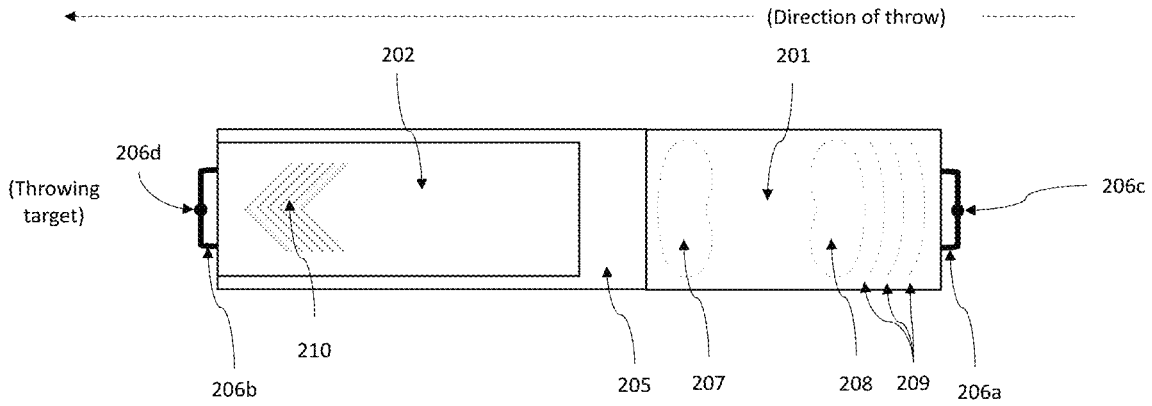
FIG. 2A is a plan view of a second embodiment.

FIG. 2A shows a plan view of a second embodiment. It differs from the first embodiment in that starting padding 203 and landing padding 204 (which will be visible in later figures of the second embodiment) are of the same dimensions as starting surface 201 and landing surface 202 respectively, and positioned directly beneath them respectively, thus starting padding 203 and landing padding 204 are not visible in the plan view. The effect of this is to make the landing targets for the thrower's front foot more dramatic and obvious, and to increase tactile feedback to the thrower because missing the landing area means dropping off both the surfaces and the padding.

Figure 3A:
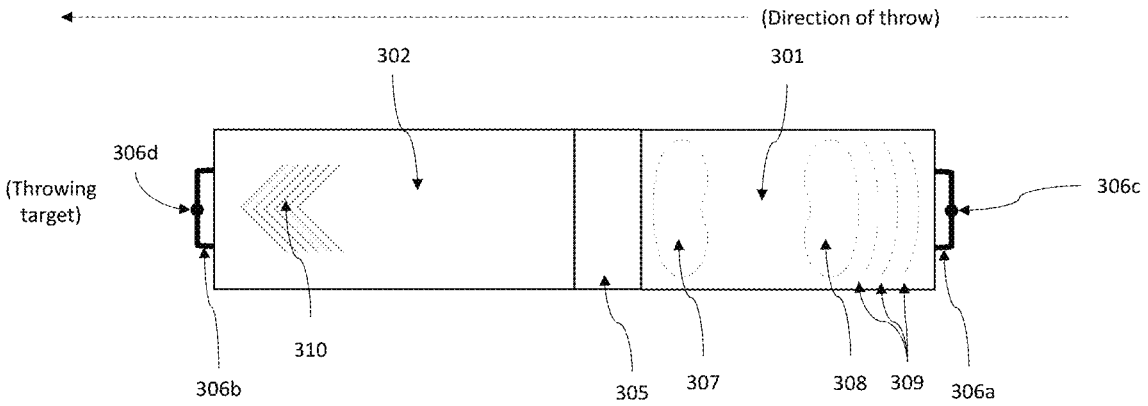
FIG. 3A is a plan view of a third embodiment.

FIG. 3A shows a plan view of a third embodiment. It differs from the second embodiment in that the landing surface 302 and landing padding 304 (which will be visible in later figures) are as wide as the starting surface 301 and starting padding 303 (which will be visible in later figures). This makes success more likely and may tend to make throwers, especially beginner throwers, feel less tense.

In the foregoing embodiments and alternative embodiments, various markings may be used to indicate the foot placements 7, 8, and 9; 207, 208, and 209; and 307, 308, and 309; as well as throwing direction 10, 210, and 310. For example, indicia 7 and 8, 207 and 208, and 307 and 308 instead of ambidextrous shoe prints may be ovals, lines, rectangles, spots, footprint shapes, and so on. For further example, in preferred embodiments the markings 7, 8, 9 and 10; 207, 208, 209 and 210; and 307, 308, 309 and 310 may be tufted or sewn. In other embodiments, markings 7, 8, 9 and 10; 207, 208, 209 and 210; and 307, 308, 309 and 310 may be painted; stamped; movably or fixedly placed as separate pieces on an upper surface of the embodiment; attached using hook-and-loop strips, such as Velcro brand fasteners; attached using a permanent or temporary adhesive; attached using magnets; attached using buttons or snaps; attached using static electricity; attached using tape; or attached using staples, screws, or other fasteners. In any embodiment, a variety of compositions and attachment means may be used on various ones of the markings, for example hook-and-loop fasteners for markings 7/207/307 disposed on a separate sheeting component, stamped marking 8/208/308 in an upper surface, tuftings in an upper surface for markings 9/209/309, and static electricity for marking 10/210/310. Note that in preferred embodiments, right-handed and left-handed throwers are equally able to use the training device to throw to the same target; they simply face opposite directions in their initial stance. Alternatively, a throwing-hand specific embodiment may be deployed with foot-shaped markings 7, 8, and/or 9; 207, 208, and/or 209; or 307, 308, and/or 309. Still other embodiments may have moveable markings 7, 8, and/or 9; 207, 208, and/or 209; or 307, 308, and/or 309 that are foot-shaped, with the marking disposed in one direction for a right-handed thrower and in the opposite direction for a left-handed thrower.

In other embodiments, various widths, heights, lengths, and separations of starting-side components 1 and 3, 201 and 203, or 301 and 303, and landing-side components 2 and 4, 202 and 204, or 302 and 304, and median portion of backing 5, 205, or 305 may be used. In other embodiments, the training device may come with multiple size options for landing surface 2, 202, or 302 which may be releasably attached to the training device to accommodate players of various sizes or skill levels (for example, a narrower landing surface 2, 202, or 302 would require a straighter step, or a landing surface 2, 202, or 302 placed a farther distance from starting surface 1, 201, or 301 would require a longer stride. In such embodiments, landing padding 4, 204, or 304 could remain in place or also be releasably attached along with landing surface 2, 202, or 302. In some embodiments, paddings 3 and 4, 203 and 204, or 303 and 304 may be unitary, but preferably a sufficiently sizeable gap between surfaces 1 and 2, 201 and 202, or 301 and 302 will be deployed to provide the thrower with tactile feedback when the thrower's step is too short.

In other embodiments, the training device may have multiple folds. In other embodiments, the training device may be two separate pieces, which may be hinged, pinned, or otherwise attached in use. In other embodiments, the training device may be a single surface with no folds. In yet other embodiments, the various pads may be sufficiently compressible for the training device to be rolled up for transport.

In preferred embodiments, the handles 6*a* and 6*b*, 206*a* and 206*b*, or 306*a* and 306*b* are made of a flexible woven material such as nylon or polyester. In other embodiments, the handles may be of a non-woven flexible material such as rubber, silicon, or other flexible material. In other embodiments, the handles may be of a more rigid material such as plastic, metal, or wood. In other embodiments, the training device may not contain handles. In other embodiments, indentations in the bottom of the training device or cutouts may be used as carrying handles.

In other embodiments, the padding 3 and 4, 203 and 204, or 303 and 304 may be extended and shaped for carrying. In other embodiments, the backing 5, 205, or 305 may be extended and be shaped or punched out for carrying.

In currently preferred embodiments, buttons along the handles 6*c* and 6*d*, 206*c* and 206*d*, or 306*c* and 306*d*, releasably connect together while the device is folded for tidy storage and transportation. In other embodiments, magnets embedded in the starting surface and landing surface may also serve to temporarily connect the sides of the device while folded, either without or in addition to handle buttons. In other embodiments hook and loop fasteners may be used on or around handles, backing, or starting/landing surfaces to releasably connect the training device in a folded or rolled position.

Figure 1B:
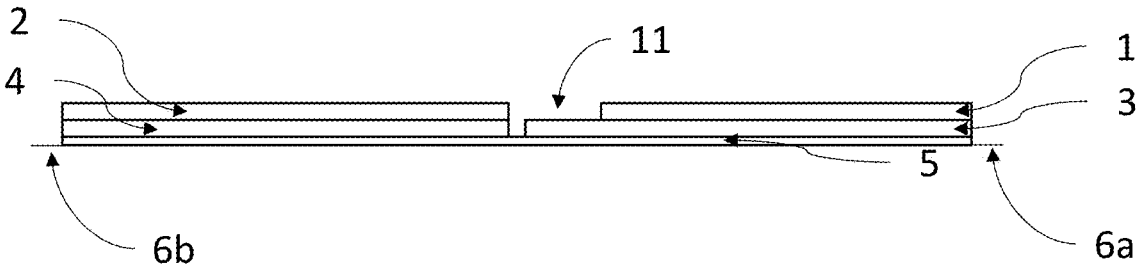
FIG. 1B is a side view of the embodiment depicted in FIG. 1A viewed along the long side at the bottom of FIG. 1A.

As shown in FIG. 1B, a first embodiment comprises three layers. A bottom layer 5 unites all sections of the mat and has non-slip properties so that the mat will not move when a thrower shifts weight around on it. The nonslip backing 5 enhances preferred embodiments' stability on the ground while a thrower uses it and unites all components.

In various embodiments, a middle layer 3 and 4 adds firmness and height.

In various embodiments, surface layers 1 and 2 provide the starting zone for the thrower's feet and the landing zone for the thrower's front foot respectively.

In various embodiments, a gap 11 between the starting surface 1 and the landing surface 2 requires the thrower to step sufficiently forward in order for the thrower's front foot to land on landing surface 2.

Figure 2B:
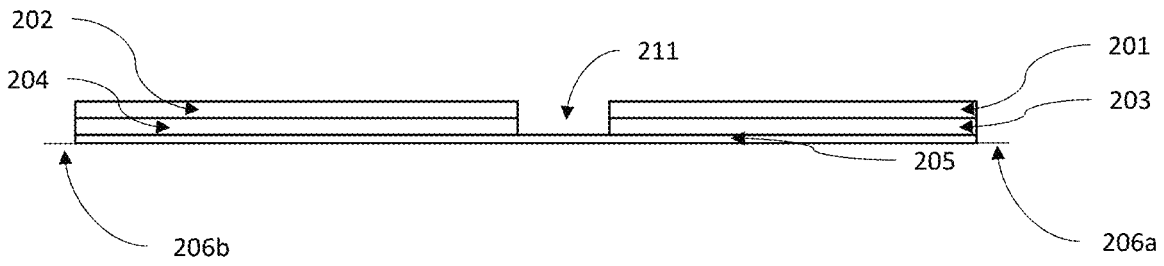
FIG. 2B is a side view of the embodiment depicted in FIG. 2A viewed along the long side at the bottom of FIG. 2A.

As seen in FIG. 2B, a second embodiment differs from the first embodiment in that starting padding 203 is of the same dimensions as starting surface 201 and positioned directly beneath it. The effect of this is to make the landing targets for the thrower's front foot more dramatic and obvious.

Figure 3B:
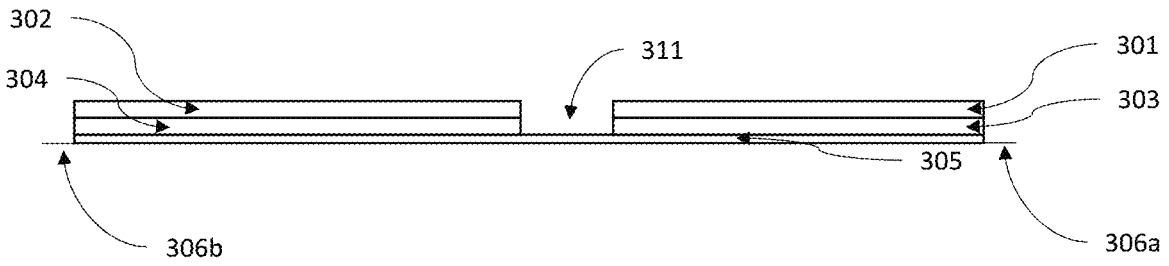
FIG. 3B is a side view of the embodiment depicted in FIG. 3A viewed along the long side at the bottom of FIG. 3A.

As seen in FIG. 3B, the third embodiment is the same as the second embodiment from this view; other views differentiate them.

In preferred embodiments, the backing 5, 205 or 305 is composed of non-slip rubber. In other embodiments, the backing may have cleats or a more defined tread for improved grip. In other embodiments, the backing may contain methods of mechanically fastening the embodiment to the ground. In other embodiments, the bottom layer 5, 205 or 305 may be omitted with a continuous form of layer 3 and 4, 203 and 204, or 303 and 304 in its place. In other embodiments, the backing may be omitted, allowing starting-side components 1 and 3, 201 and 203, or 301 and 303, and landing-side components 2 and 4, 202 and 204, or 302 and 304 to be two independent pieces, which in some embodiments may be joined in use and in other embodiments may be separated in use, preferably with each lower component comprising some ground-or-floor fixing means such as described above. In some embodiments, lateral and/or longitudinal stability of the training device may be enhanced by deploying multiple gripping means (e.g., both treads and spikes), or by deploying interchangeable gripping means that are selectable depending on the surface on which the training device is to be used.

In preferred embodiments, middle layers 3 and 4, 203 and 204, or 303 and 304 are composed of closed cell EVA foam. In other embodiments, the middle layer may be an alternative material such as plastic, polyethylene foam, wood, compressed foam, Styrofoam, recycled rubber buffing, recycled crumb rubber, or any suitable material for walking and stepping on. In other embodiments, the middle layer may be replaced by a thicker bottom layer 5, 205 or 305 or thicker top layer 1 and 2, 201 and 202, or 301 and 302.

In currently preferred embodiments, the top layers 1 and 2, 201 and 202, or 301 and 302 comprise synthetic turf, evocative of a desirable throwing surface and distinct in feel and sound. In other embodiments, top layers may be an alternative of any suitable material sufficient to withstand a person standing and moving on it, such as vinyl, polymeric material, rubber, artificial turf, carpet, or similar materials, preferably that provide secure footing for the user. In other embodiments, the training device surfaces may be unitary, preferably carved or molded to resemble the shape of the preferred embodiment. In other embodiments, if the material used for the top layer is short, then the top layer could become two layers, with the lower layer being of similar material as the middle layer 3 and 4, 203 and 204, or 303 and 304 to maintain the preferred shape and tactile feedback of preferred embodiment.

The layers 1, 2, 3, 4, and 5; 201, 202, 203, 204 and 205; or 301, 302, 303, 304 and 305 preferably are securely attached to one another. In preferred embodiments, a glue adhesive is used. In other embodiments, hook-and-loop strips, such as Velcro brand fasteners, may be used. In other embodiments, zippers may be used. In other embodiments, buttons or snaps may be used. In other embodiments, magnets may be used. In other embodiments, staples may be used. In other embodiments, stitching may be used. In other embodiments, plastic or metal straps may be used. In other embodiments, mechanical clamps may be used. In other embodiments, rivets or screws may be used. In other embodiments, one or more layers may be replaced by substituting a carved or molded layer, preferably that maintains the overall general shape of the preferred embodiment. In the preferred embodiment, all three layers are flexible enough to accommodate any reasonable unevenness in the throwing surface without wobbling during use but are resilient to the downward pressure of a person standing on the mat. In other embodiments, more rigid materials may be used providing less flexibility.

In the preferred embodiment, the handles 6*a* and 6*b*, 206*a* and 206*b*, or 306*a* and 306*b*, are securely attached to the underside of the non-slip rubber backing 5, 205, or 305 with a flat profile so as not to cause any perceptible unevenness in the training device during use. In other embodiments, the handles may be fastened to a different part of the training device such as the middle layer 3 and 4, 203 and 204, or 303 and 304, or to the top layer 1 and 2, 201 and 202, or 301 and 302.

Figure 1C:
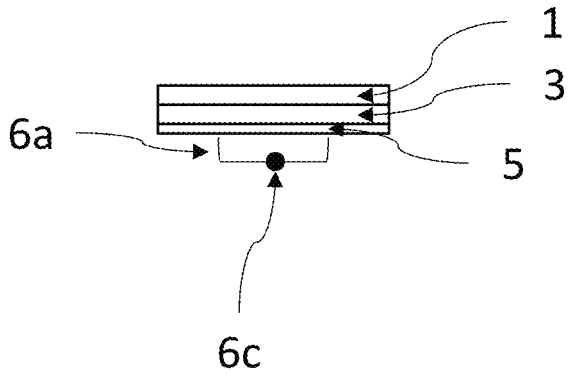
FIG. 1C is another side view of the embodiment depicted in FIG. 1A viewed along the short side at the right of FIG. 1A.

FIG. 1C shows the profile view of the first embodiment along a short side—the side that comprises the starting surface 1 as labeled in FIG. 1A. As shown, it further comprises the non-slip rubber backing 5, the starting padding 3, the starting surface 1, and carrying handle 6*a*.

Figure 2C:
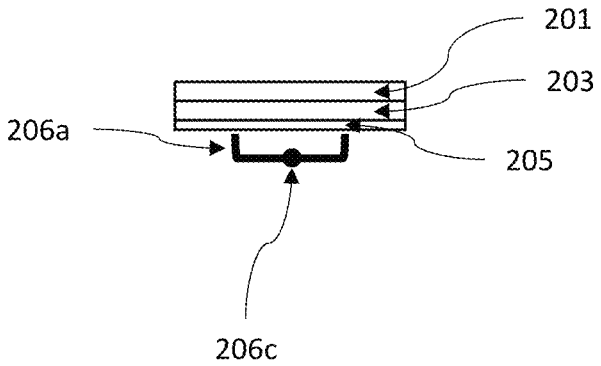
FIG. 2C is another side view of the embodiment depicted in FIG. 2A viewed along the short side at the right of FIG. 2A.
Figure 3C:
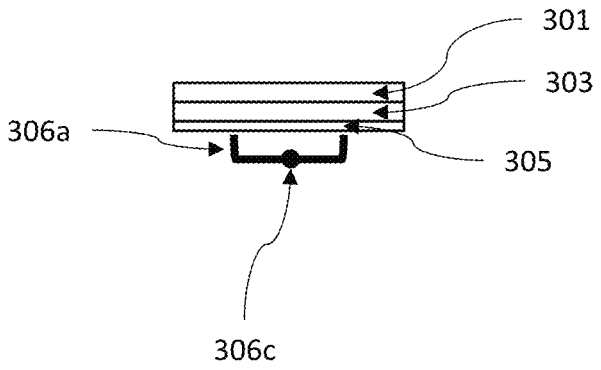
FIG. 3C is another side view of the embodiment depicted in FIG. 3A viewed along the short side at the right of FIG. 3A.

FIGS. 2C and 3C show that the second and third embodiments are the same as the first embodiment with respect to this view; other views differentiate them.

Figure 1D:
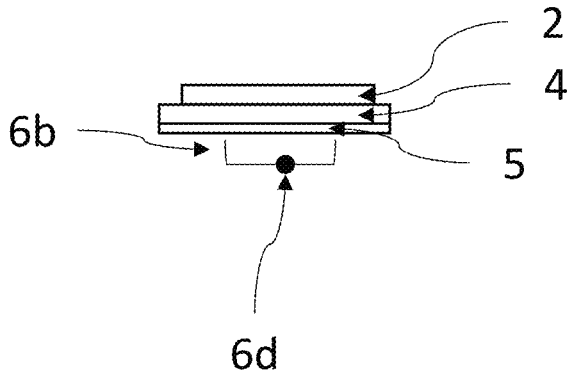
FIG. 1D is another side view of the embodiment depicted in FIG. 1A viewed along the short side at the left of FIG. 1A.

FIG. 1D shows the profile view of the first embodiment along a short side—the side that comprises the landing surface 2 as labeled in FIG. 1A. As shown, it further comprises the non-slip rubber backing 5, the landing padding 4, the landing surface 2, and the carrying handle 6*b*. Note that the landing surface is narrow, requiring the thrower to step straight with their toe rotating fully or partially toward the target in order to land cleanly on it.

Figure 2D:
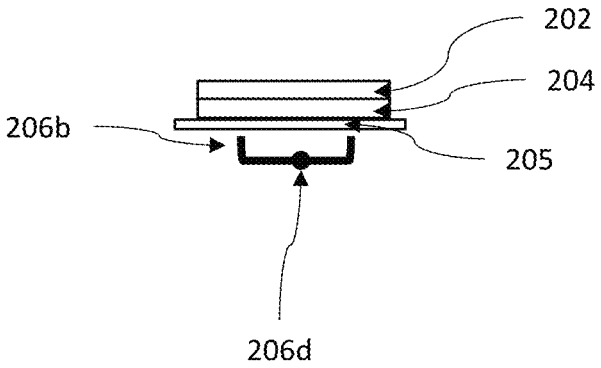
FIG. 2D is another side view of the embodiment depicted in FIG. 2A viewed along the short side at the left of FIG. 2A.

FIG. 2D shows that the second embodiment differs from the first embodiment in that the landing padding 204 is as narrow as the landing surface 202—both narrower than the starting surface 201, as evidenced by cross-referencing to FIG. 2A. This requires a straighter forward step and makes the dropoff more obvious and dramatic if the thrower's front foot misses the target area.

Figure 3D:
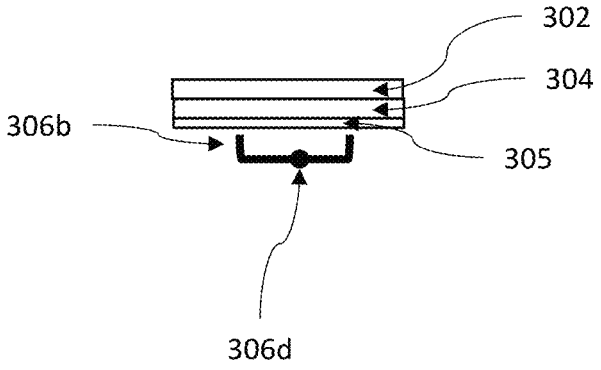
FIG. 3D is another side view of the embodiment depicted in FIG. 3A viewed along the short side at the left of FIG. 3A.

FIG. 3D shows that, in the third embodiment, both the landing surface 302 and landing padding 304 are as wide as starting surface 301, as evidenced by cross-referencing to FIG. 3A. This makes it more likely that the thrower will be successfully in landing the front foot on the landing area and may make the thrower less tense.

Figure 1E:
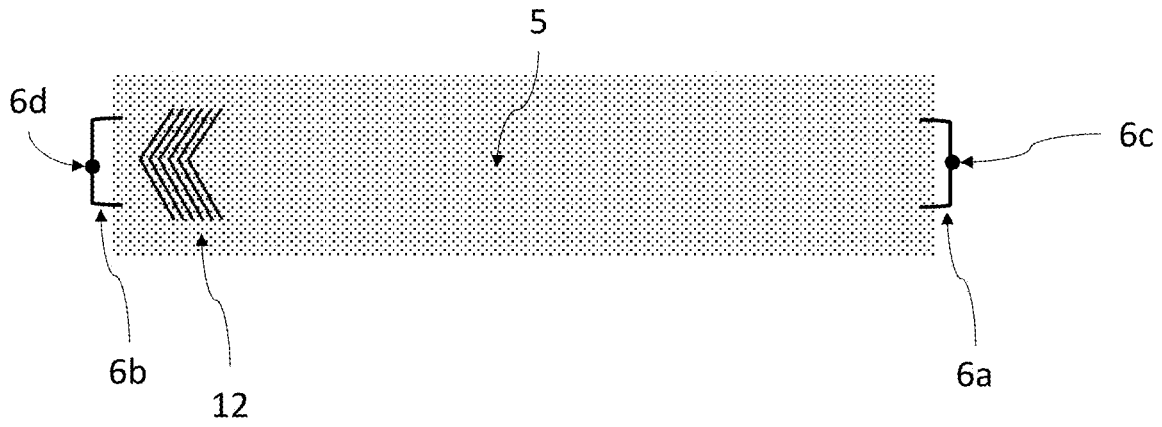
FIG. 1E is the bottom view of the embodiment depicted in FIG. 1A.

FIG. 1E shows the bottom view of the first embodiment. As shown, the non-slip rubber backing 5 unites the components of the preferred embodiment, and the carrying handles 6*a* and 6*b* are securely attached to it. For convenience, arrows 12 show the user which side is the landing side while the product is folded up, so the user can unfold the product in the intended orientation.

Figure 2E:
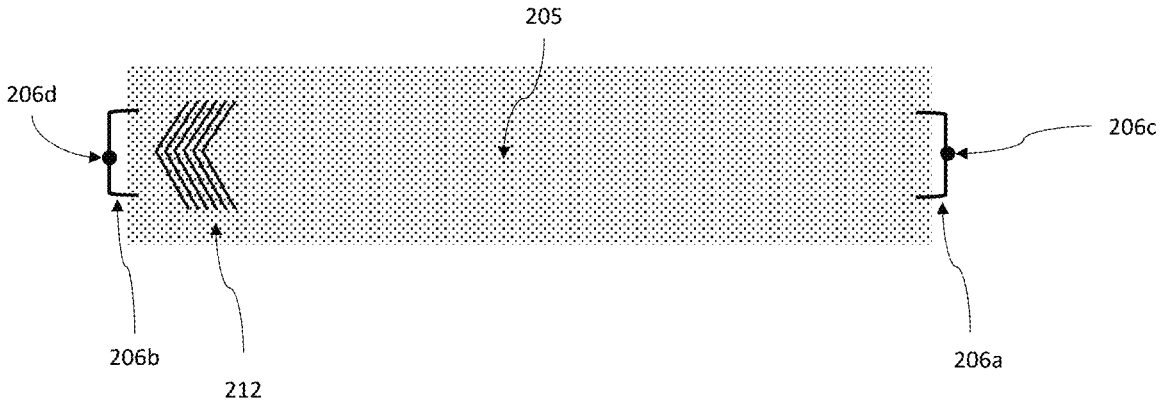
FIG. 2E is the bottom view of the embodiment depicted in FIG. 2A.
Figure 3E:
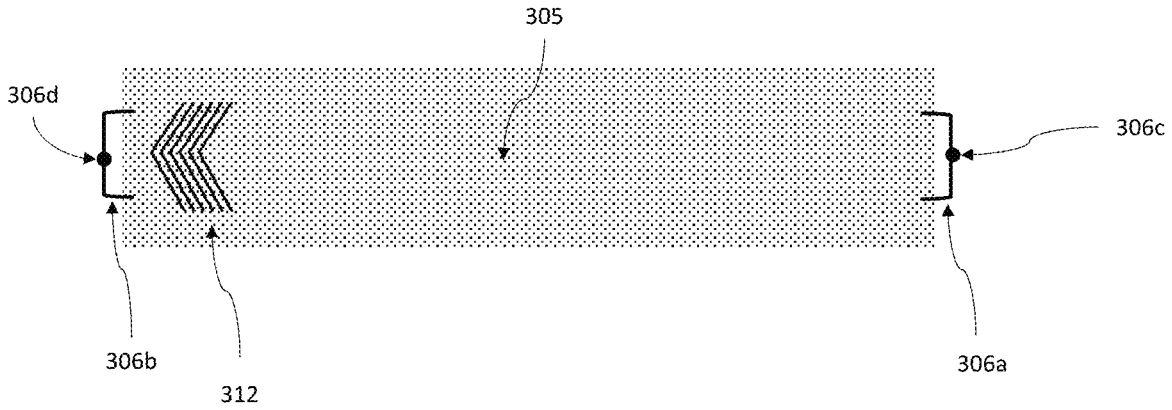
FIG. 3E is the bottom view of the embodiment depicted in FIG. 3A.

FIGS. 2E and 3E show that the first, second and third embodiments are the same with respect to this view; other views show differences.

Figure 1F:
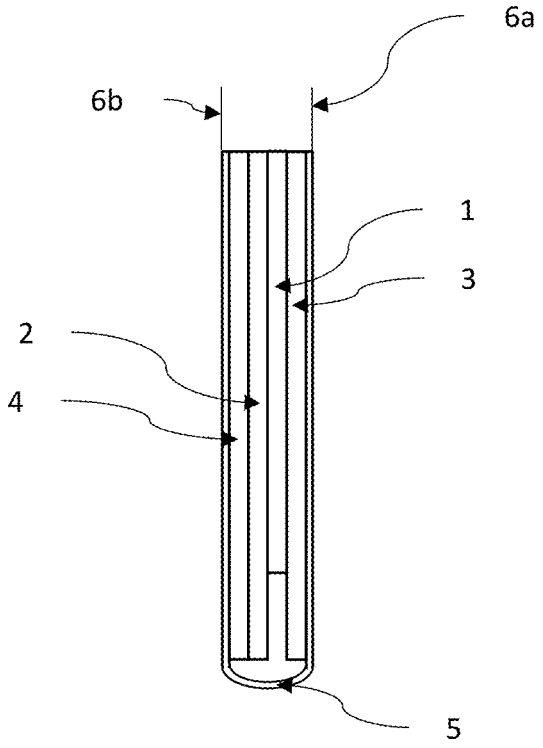
FIG. 1F is a side view of the embodiment depicted in FIG. 1A arranged in a folded configuration.

FIG. 1F shows the folded view of the first embodiment. In this view, the starting surface 1 is on the right side, folded inward. The gap between the starting surface 1 and the landing surface 2, and the break between the starting padding 3 and the landing padding 4, and the flexibility of all layers including the non-slip rubber backing 5, allows for this folding, with the central portion of backing 5 serving as a general hinge means. The carrying handles 6*a* and 6*b* enhance carrying in this position. Handle buttons 6*c* and 6*d*, visible in FIG. 1A, further enhance carrying and tidy storage in this position. Alternatives for the handle buttons are mentioned in the discussion of FIG. 1A above.

Figure 2F:
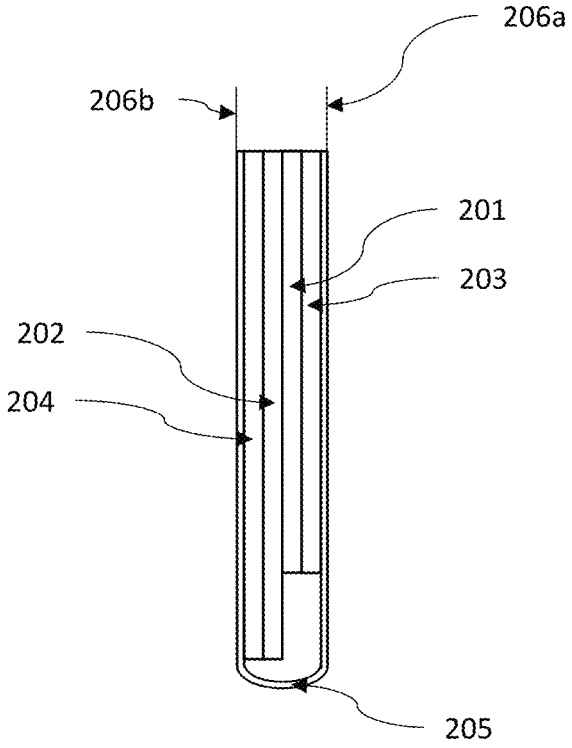
FIG. 2F is a side view of the embodiment depicted in FIG. 2A arranged in a folded configuration.

FIG. 2F shows the folded view of the second embodiment. As shown and as mentioned above, it differs from the first embodiment in that the starting padding 203 is of the same dimension and positioned directly beneath starting surface 201.

Figure 3F:
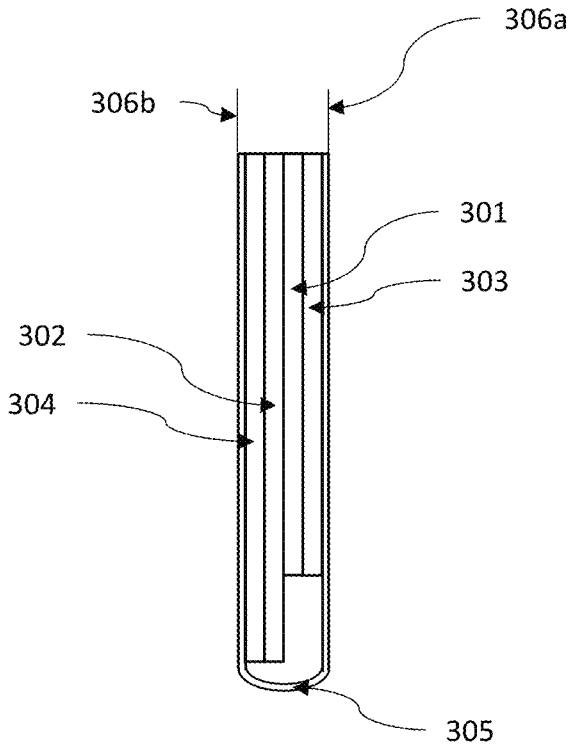
FIG. 3F is a side view of the embodiment depicted in FIG. 3A arranged in a folded configuration.

FIG. 3F shows the folded view of the third embodiment. With respect to this view, the second and third embodiments appear the same; other views show differences.

In the foregoing embodiments and alternative embodiments, a hinge means may comprise a knuckle and pin, or other flexible joining means. In other embodiments, the training device may fold outward with surface 1 and 2, 201 and 202, or 301 and 302 facing out after the fold. In other embodiments, the training device may have more than one fold. In other embodiments, the training device may not fold. In other embodiments, the training device may be rolled up for carrying.

In a currently preferred embodiment rigorous testing and trials have shown the following dimensions to be advantageous. Designing this device within these preferred ranges provides the unexpected benefit of the users always knowing when the step incorrectly by receiving tactile and instant feedback without looking down.

| Figure Reference | Description | Preferred Embodiment Measurement | Preferred Range |
|---|---|---|---|
| FIG. 1A | | | |
| 1 | Starting Surface Length | 22.80" | 6"-60" |
| 1 | Starting Surface Width | 11.97" | 6"-60" |
| 3 | Starting Pad Length | 26.22" | 6"-60" |
| 3 | Starting Pad Width | 11.97" | 6"-60" |
| 5 | Padding Break | 1.57" | 0"-12" |
| 2 | Landing Surface Length | 26.22" | 6"-60" |
| 2 | Landing Surface Width | 10.0" | 2"-60" |
| 4 | Landing Pad Length | 26.22" | 6"-60" |
| 4 | Landing Pad Width | 26.22" | 2"-60" |
| FIG. 1B | | | |
| 11 | Gap Length | 5.0" | 0"-36" |
| 5 | Backing Thickness | 0.12" | 0"-6" |
| 3 | Starting Pad Thickness | 0.39" | 0"-6" |
| 4 | Landing Pad Thickness | 0.39" | 0"-6" |
| 1 | Starting Surface Thickness | 0.79" | 0"-6" |
| 2 | Landing Surface Thickness | 0.79" | 0"-6" |

Although embodiments described above have been discussed involving throwing maneuvers, many of those embodiments may also be used for other athletic maneuvers including batting.

The invention claimed is:

1. A device for training throwing footwork, comprising:

a backing that serves as a bottom layer of the device when in contact with ground or other supporting surface, wherein the backing is configured to reduce slippage when in contact with the ground or other supporting surface;

starting padding disposed at a first area on a first side of the backing opposite to a second side of the backing that is configured for contact with the ground or other supporting surface;

a starting surface present on a first side of the starting padding opposite to a second side of the starting padding that is in contact with the backing, wherein the starting surface is sized to accommodate both feet of a thrower standing in a throwing stance on the starting surface;

landing padding disposed at a second area on the first side of the backing; and a landing surface present on a first side of the landing padding opposite to a second side of the landing padding that is in contact with the backing, the landing surface being sized to accommodate landing of at least a front foot of the thrower, wherein the starting surface comprises markings indicative of foot placement and the landing surface comprises markings indicative of a throwing direction.

2. The device of claim 1, wherein a gap is defined between starting-side components and landing-side components, wherein the starting-side components comprise the starting padding and the starting surface and the landing-side components comprise the landing padding and the landing surface.

3. The device of claim 1, wherein the backing, the starting padding, the starting surface, the landing padding and the landing surface are unified layers.

4. The device of claim 1, wherein a width of the landing surface exists within a preferred range such that tactile feedback is provided to the thrower when the front foot of the thrower does not land completely on the landing surface.

5. The device of claim 1, wherein a height of the landing surface and the landing padding exists within a preferred range such that tactile feedback is provided to the thrower when the thrower does not land completely on the landing surface, while still allowing the thrower's feet to land safely.

6. The device of claim 1, wherein the device is configured to be foldable or rollable so as to place the device in a configuration for storage or transport when not in use.

7. The device of claim 1, wherein the backing, starting padding, starting surface, landing padding, and landing surface are rectilinear in shape.

8. The device of claim 1, wherein the starting surface is present on less than an entirety of the first side of the starting padding and/or the landing surface is present on less than an entirety of the first side of the landing padding.

9. The device of claim 1, wherein the starting surface comprises artificial turf or other tufting and/or the landing surface comprises the artificial turf or other tufting.

10. The device of claim 1, wherein the starting padding and the landing padding provide support beneath the starting surface and the landing surface, respectively.

11. The device of claim 2, wherein the backing is continuous so as unite the starting-side components and the landing-side components, while preserving the gap defined between the starting-side components and the landing-side components.

12. The device of claim 2, wherein at least two of the backing, the starting padding, and the starting surface are unified layers, and/or at least two of the backing, the landing padding and the landing surface are unified layers.

13. The device of claim 1, wherein the starting surface comprises markings indicative of foot placements that are ambidextrous for either handedness of the thrower.

14. The device of claim 1, wherein the device is configured such that:

the thrower stands in a throwing position on the starting surface with each foot on the starting surface that is supported at least in part by the starting padding disposed at the first area on the first side of the backing; and then the thrower steps with the front foot during a throwing motion towards the landing surface that is supported at least in part by the landing padding disposed at the second area on the first side of the backing such that:

tactile feedback for proper footwork during the throwing motion occurs when the front foot lands on the landing surface, whereas tactile feedback for improper footwork occurs when the front foot fails to land on the landing surface.

15. A method for training footwork of a thrower using the device of claim 1, comprising:

standing in a throwing position on the starting surface with each foot on the starting surface that is supported at least in part by the starting padding disposed at the first area on the first side of the backing;

stepping with the front foot during a throwing motion towards the landing surface that is supported at least in part by the landing padding disposed at the second area on the first side of the backing; and receiving tactile feedback during the throwing motion such that tactile feedback of proper footwork during the throwing motion is received when the front foot lands on the landing surface, whereas tactile feedback of improper footwork is received when the front foot fails to land on the landing surface.

16. The method of claim 15, further comprising unfolding or unrolling the device and placing the backing in contact with the ground or other supporting surface before standing in the throwing position on the starting surface.

17. The method of claim 15, wherein the backing, the starting padding, the starting surface, the landing padding, and the landing surface are rectilinear in shape.

18. The method of claim 15, wherein the starting surface comprises artificial turf or other tufting and/or the landing surface comprises the artificial turf or other tufting.

* * * * *